United States Patent [19]

Arner et al.

[11] Patent Number: 4,867,319

[45] Date of Patent: Sep. 19, 1989

[54] DRAWER ORGANIZER WITH REMOVABLE SECTIONS AND BLANK THEREFOR

[75] Inventors: Barbara D. Arner, 4924 Amalfi Way, Oxnard, Calif. 93035; Kenneth A. Tarlow, Playa del Rey, Calif.

[73] Assignee: Barbara D. Arner, Oxnard, Calif.

[21] Appl. No.: 253,688

[22] Filed: Oct. 5, 1988

Related U.S. Application Data

[63] Continuation-in-part of Ser. No. 71,036, Jul. 8, 1987, abandoned.

[51] Int. Cl.[4] ..... A47F 7/16

[52] U.S. Cl. ..... 211/46; 312/184

[58] Field of Search ..... 312/183, 184, 264, 265; 220/82 R; 211/45, 46; 229/DIG. 3, 268

[56] References Cited

U.S. PATENT DOCUMENTS

| | | | |
|---|---|---|---|
| 650,699 | 5/1900 | Williams | 312/264 |
| 1,917,980 | 7/1933 | Kelsey | 312/183 |
| 2,233,798 | 11/1943 | Kner | 220/689 |
| 3,017,987 | 1/1962 | Moslo | 220/68 R |
| 3,874,753 | 4/1975 | Naito et al. | 312/263 |
| 4,262,810 | 4/1981 | Ilich | 312/184 X |

FOREIGN PATENT DOCUMENTS

| | | | |
|---|---|---|---|
| 1264 | 3/1987 | PCT Int'l Appl. | 211/46 |

*Primary Examiner*—Joseph Falk

*Attorney, Agent, or Firm*—Poms, Smith, Lande & Rose

[57] ABSTRACT

A drawer organizer having a plurality of spaced linearly aligned separate suspended sections that can hold various articles of clothing or the like. The sections are selectively expandable and compactible and have mid-translucent portions for accommodating articles of clothing of varying dimensions. The sections may be formed from a blank providing ease of manufacture.

5 Claims, 4 Drawing Sheets

FIG. 1
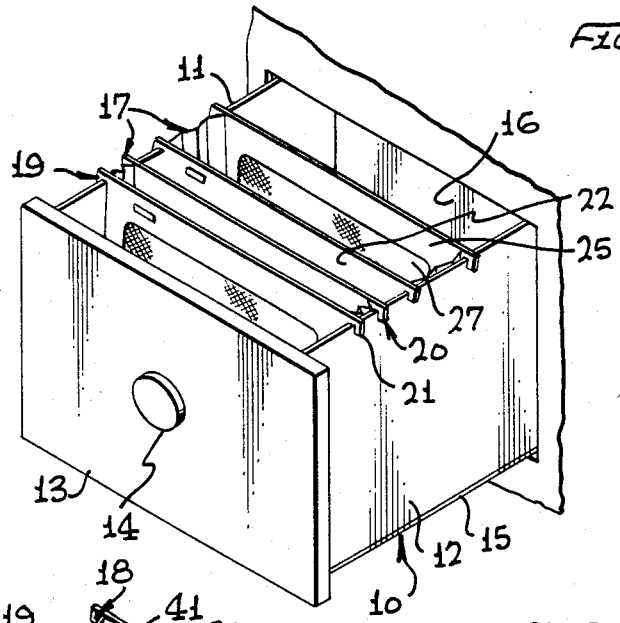
FIG. 5
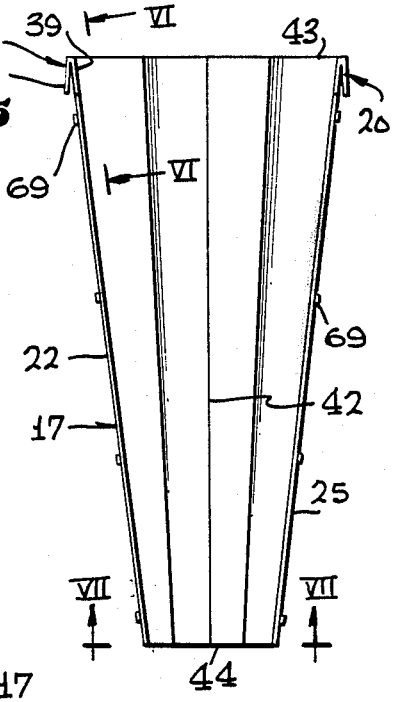
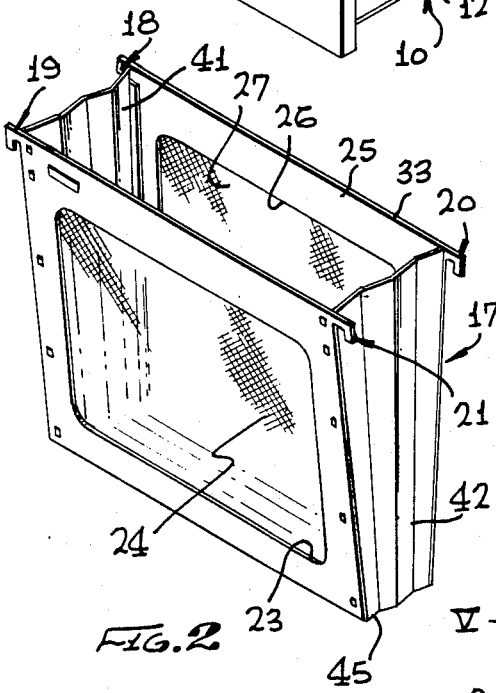
FIG. 2
FIG. 3
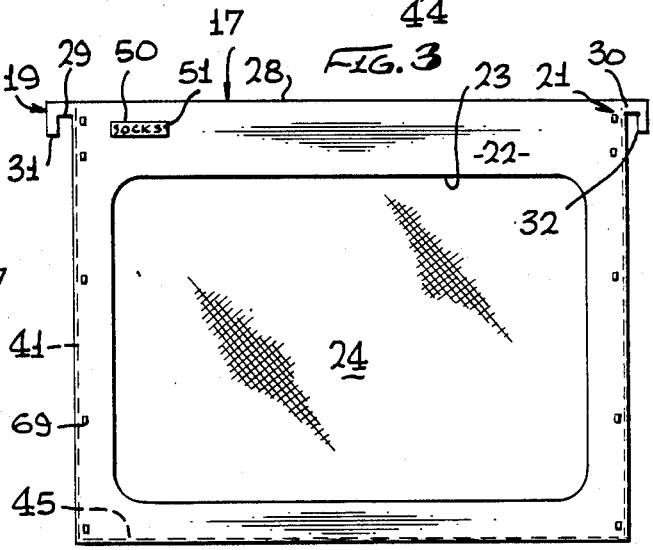
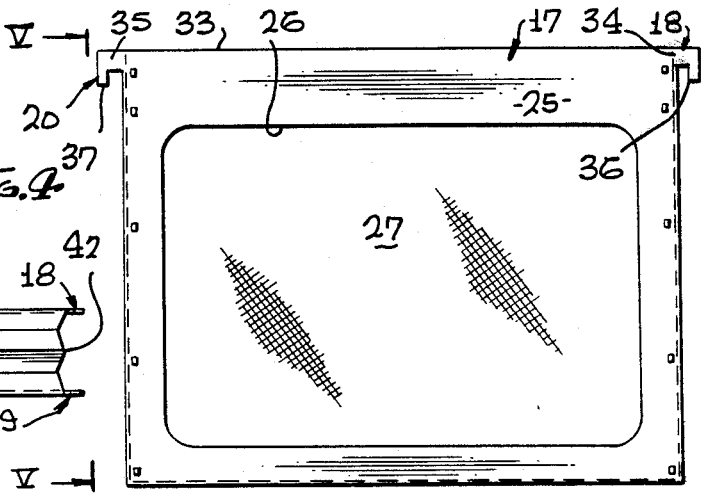
FIG. 4
FIG. 7
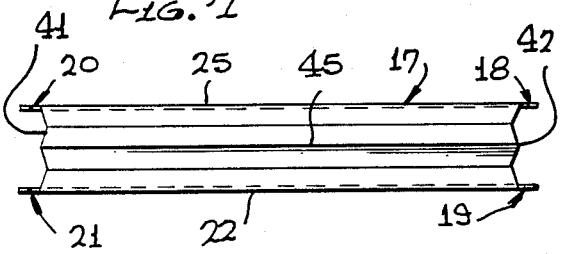

FIG. 10
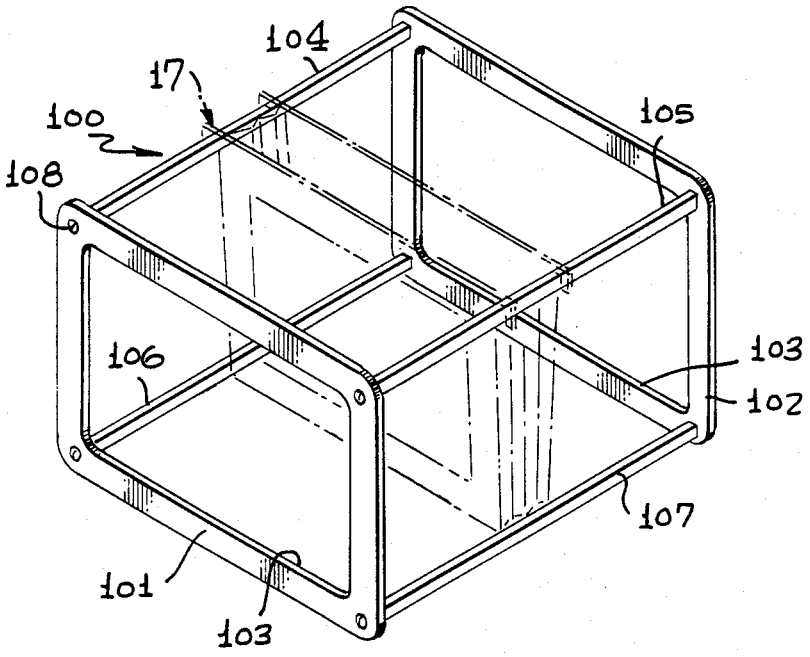
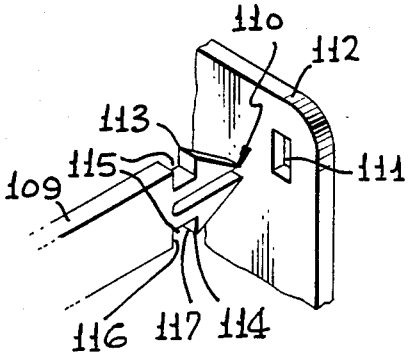
FIG. 11
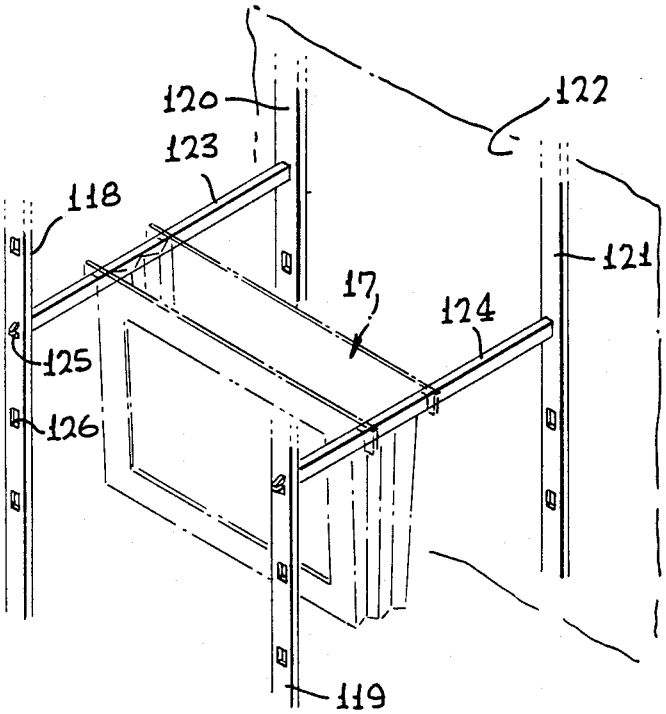
FIG. 12
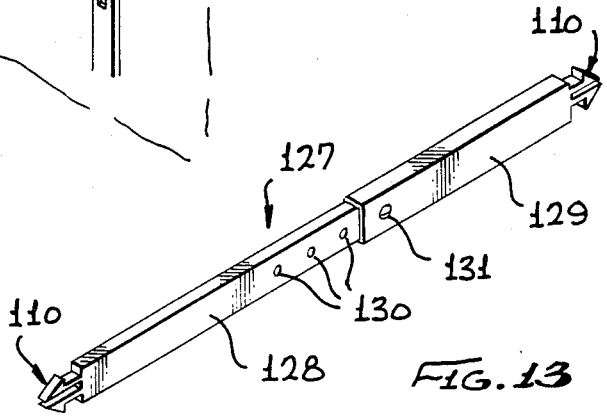
FIG. 13

DRAWER ORGANIZER WITH REMOVABLE SECTIONS AND BLANK THEREFOR

REFERENCE TO RELATED APPLICATION

This application is a continuation-in-part of application Ser. No. 07/071,036, filed Jul. 8, 1987, now abandoned.

BACKGROUND OF THE INVENTION

1. Field of the Invention

The invention relates to drawer organizers; and, more particularly, to apparatus for organizing the interior of a box, drawer or closet in a neat, orderly manner by providing a plurality of spaced linearly aligned separate suspended sections in the box, drawer or closet.

2. Description of the Prior Art

Almost every home has a dresser or other similar type of furniture with drawers that pull out and can be used to hold various articles of clothing, such as stockings, underwear, etc. Such items of clothing are usually merely thrown into the drawer and the user must rummage through the various articles in the drawer to find one particular item. There is a need for a way to organize such drawers or provide independent boxes or drawers so that the different items can be segregated so that one particular item can be quickly and easily retrieved from the drawer. In recent years, many people have organized their closets. Such means for organizing clothes and the like should be relatively inexpensive, easy to set up and install, and useful in boxes, drawers or in closets.

SUMMARY OF THE INVENTION

It is an object of the invention to provide a drawer organizer for organizing the interior of a box or drawer or the like.

It is a further object of this invention to provide a drawer organizer having separate suspended independent sections which allow the interior contents to be viewed without withdrawal of the section from the drawer.

It is still further an object of this invention to provide a separate suspended independent section for a drawer organizer which can quickly and easily be substituted for another section in the drawer without removal of the remaining sections.

It is further an object of this invention to provide a blank which can be formed out of planar material, then folded to form a separate independent suspendible section having open sides thereon.

These and other objects are preferably accomplished by providing a drawer organizer having a plurality of spaced linearly aligned separate suspended sections that can hold various articles of clothing or the like. The sections are selectively expandable and compactible and have translucent sides for accommodating articles of clothing of varying dimensions. The sections, except for the translucent sides, may be formed from a blank providing ease of manufacture.

BRIEF DESCRIPTION OF THE DRAWING

FIG. 1 is a perspective view of a drawer and organizers therein in accordance with the invention;

FIG. 2 is a perspective view of one of the organizers of FIG. 1.

FIG. 3 is a vertical front view of the organizer of FIG. 2;

FIG. 4 is a vertical rear view of the organizer of FIG. 3;

FIG. 5 is taken along lines V—V of the organizer of FIG. 4;

FIG. 7 is a view taken along lines VII—VII of FIG. 5;

FIG. 10 is a perspective view of a knockdown box for use with the organizers of FIGS. 1–9;

FIG. 11 is an exploded view of a portion of knockdown box illustrating a modification thereof;

FIG. 12 is a perspective view of a closet arrangement using the organizers of the invention;

FIG. 13 is a perspective view of a modified rail for the boxes of FIGS. 10–12;

FIG. 20 is a perspective view of another embodiment of a drawer organizer;

FIG. 21 is a plan view of a blank for forming the organizer of FIG. 20;

FIG. 22 is a side sectional view of a portion of the assembled organizer of FIG. 20;

FIGS. 23 and 24 are views taken along lines XXIII—XXIII and XXIV—XXIV of FIG. 22, respectively;

FIG. 25 is a perspective view of another embodiment of a knockdown box in accordance with the invention;

FIG. 26 is a vertical view of a portion of the assembled box of FIG. 25 illustrating connection of the parts thereof;

FIG. 27 is a view taken along lines XXVII—XXVII of FIG. 26;

FIG. 28 is a view taken along lines XXVIII—XXVIII of FIG. 27; and

FIG. 29 is a perspective view showing a plurality of the organizers of FIGS. 20 to 24 mounted in a plurality of the boxes of FIGS. 25 to 28, the boxes in turn mounted in a conventional drawer.

DESCRIPTION OF THE PREFERRED EMBODIMENT

Figures 6, 8, 9:
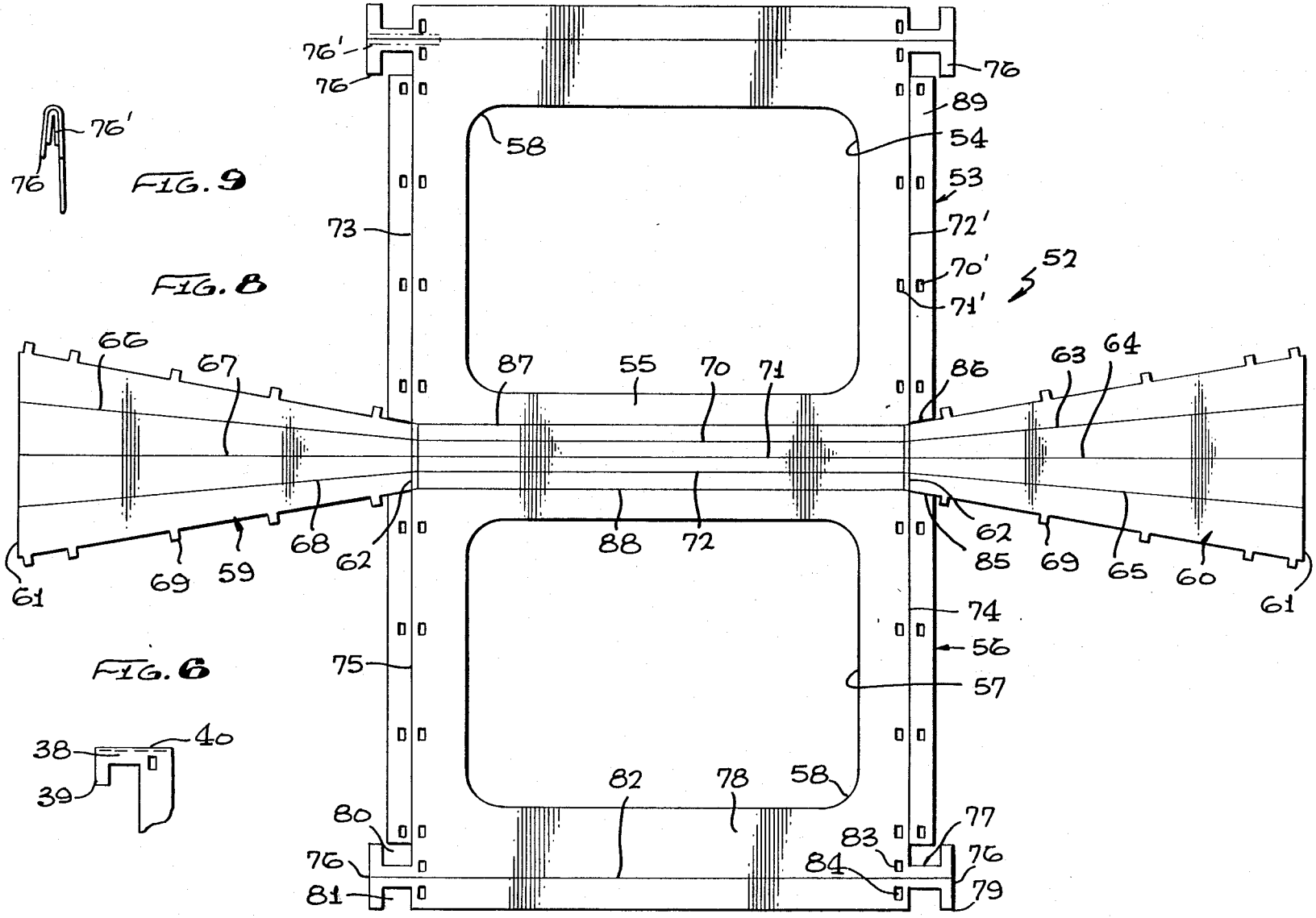
FIG. 6 is a view taken along lines VI—VI of FIG. 5.
FIG. 8 is a plan view of a blank for forming the organizer of FIGS. 2 to 7.
FIG. 9 a detailed view of a portion of the organizer of FIGS. 2 to 7.

Referring now to FIG. 1 of the drawing, a drawer 10 is shown which is a conventional drawer having a pair of spaced side walls 11, 12, a front wall 13 with a pull knob 14, a bottom wall 15 and a back wall 16. Drawer 10 is thus open at the top and includes a plurality of drawer organizers 17 suspended from the upper edges of side walls 11, 12.

As seen in FIG. 2, each organizer 17 is a separate independent section or organizer which can be suspended, via hook members 18 to 21, on the upper edges of side walls 11, 12 as seen in FIG. 1.

As seen in FIG. 3, each section 17 includes a planar front wall 22 having a cut-out portion 23 which may be covered by a flexible mesh-like material 24 so that the contents of the interior of each section 17 can be viewed and air can circulate therethrough. Each section 17 includes a rear wall 25 (FIG. 4) also having a cut-out portion 26 covered with a flexible mesh-like material 27. Hook members 19, 21 are provided on the upper edge 28 of front wall 22 by means of a pair of laterally extending extension portions 29, 30, (FIG. 3) on each side thereof, integral with downwardly extension portions 31, 32, respectively. Hook members 18, 20 are provided on the upper edge 33 (FIG. 4) of rear wall 25 by means of a pair of laterally extending extension portions 34, 35, on each side thereof, integral with downwardly extending portions 36, 37, respectively.

Although the hook members 18 to 21 can be formed from flat planar material integral with the remaining planar material of front and rear walls 22, 25, as seen in FIG. 5, each hook member 18 to 21 may be comprised of the aforementioned laterally extending extension portions and integral downwardly extending portions (for example, portions 30, 32 forming hook member 21 in FIGS. 3 and 5) and a similar laterally extending extension portion 38 (FIG. 6) and downwardly extending integral portion 39 joined at the top to extension portions 29, 31 along seam or line 40—FIG. 6.

As seen in FIGS. 2 and 5, flexible side walls 41, 42 interconnect front and rear walls 22, 25, respectively. Each side wall 41, 42 is comprised of a trapezoidally-shaped insert of flexible pleated material wider at the top 43 (FIG. 5) than at the bottom 44 joined to front and rear walls 22, 25 in any suitable manner.

As seen in FIG. 7, the bottom of each section 17 is closed off by a bottom wall 45 which may also be of a flexible pleated material (or non-pleated, if desired) joined to side walls 41, 42 and the bottom of front and rear walls 22, 25 in any suitable manner.

The front and back walls 22, 25 may be made of any suitable materials, such as stiff cardboard, wood, metal, plastic, etc. The bottom wall 45 may be of similar material (if solid) or of the same material as sides 41, 42 (if flexible). The latter material may be cardboard, plastic, vinyl, etc. The mesh 24 and 27 may be of any suitable mesh size and flexible material, such as a cloth material, and glued or otherwise secured to the inside of the front and back walls 22, 25. All the sections may be secured together in any suitable manner, such as by gluing, heat sealing, stapling, etc.

As seen in FIG. 1, one or more sections 17 are suspended in drawer 10 along the top of side walls 11, 12. Depending on the number of sections 17 and size of drawer 10, the sections 17 can be squeezed together or collapsed so that a great number can be accommodated in drawer 10. The mesh 24 and 27 allows inspection of the items in the interior of each section 17 and permits air to circulate therethrough. If desired, as seen in FIGS. 1 and 3, a plate 50 may be provided on the upper surface of the front wall 22 having indicia 51 thereon for indicating the interior contents of each section 17.

As heretofore stated, the various parts of each section 17 may be manufactured in any suitable manner and using any suitable materials. Front and rear walls 22, 25 may be identical and they may each be stamped out of planar material, such as plastic.

Alternatively, the front, rear, bottom and side walls may be stamped out of a single sheet of material. Thus, as seen in FIG. 8, a blank 52 is shown having a first rectangular section 53 with a rectangular cut-out portion 54 connected via an elongated strip 55 to a like second rectangular section 56 also having a cut-out portion 57. The corners 58 of each cut-out portion 54, 57 may be rounded as shown.

A pair of trapezoidally-shaped lateral members 59, 60 extend from and are integral with strip 55 on opposite sides thereof. Each member 59, 60 is wider at top 61 than at the bottom 62 (point of connection to strip 55) and each member 59, 60 (and also strip 55) may have fold lines (lines 63–65 on member 60 and lines 66–68 on member 59, and lines 70 to 72 on strip 55, for example) where these portions can be folded or accordioned.

Blank 52 has a plurality of spaced tabs 69 along the elongated sides of each member 59, 60. Each section 53, 56 has a pair of rows of a plurality of spaced slots (slots 70′ in the outer row formed an outer tab 89 and slots 71′ in the inner row). These rows are separated by a fold line (such as lines 72′, 73 on member 53 and lines 74, 75 on member 56.

A T-shaped member 76, reinforced, if desired, by a flat shim 76′, for stiffness, may be provided at the outer corners of each member 53, 56. Each member 76 has a first extension portion 77 integral with and extending from an outer flap member 78 extending along the outer edge of each member 53 and 56. A cross member 79 is connected to extension portion 77 (extending beyond the outer edge of each member 53, 56). As seen in FIG. 8, these T-shaped members are formed by cutting out square-shaped sections of the blank 52 (as sections 80, 81). A fold line 82 extends through the middle of cross member 79 and extension portion 77 through the middle of flap portion 78 from one member 76 to the other member 76. A pair of slots 83, 84 are cut-out on each side of each fold line 82 adjacent sections 80, 81, as shown. Notches or slots 85, 86 are cut-out on each side of each member 59, 60 extending from the fold line 62 outwardly to the outer surface of each member 53, 56. Finally, fold lines 87, 88 are provided along each side of strip 55.

In assembling blank 52, the blank 52 is folded along fold lines 62, 87 and 88. The side tabs 89 are folded along lines 72–75 back to the interior thereof so that slots 70′ align with slots 71′. The tabs 69 are inserted into aligned slots 70′, 71′ and bent to maintain the members 59, 60 coupled to the members 53, 56.

The outer tabs 78 are folded along lines 82 forming hook members at extension portions 77 and cross members 79. The cut-out sections 80, 81 overlap to form a hooking area.

The mesh material 24 and 27 (FIGS. 3 and 4) may be secured in the cut-out sections 54, 57 in any suitable manner. The tabs 69 may be heat-sealed within the aligned slots 70′, 71′. Any suitable member and arrangement of tabs and slots may be used. It is noted that the outermost tabs 69 are receivable in the aligned slots 83, 84 (when folded along lines 82) The side and bottom portions 59, 60 and 55 may be folded or pleated along fold lines 63–68 and 70–72 so that they can be compressed when suspended in the drawer.

It can be seen that there is disclosed a unique arrangement for organizing clothing and other items in a drawer or the like. The sections 17 can vary in size so that any suitable drawer can be used to accommodate a plurality of separate independent sections. The contents of each section are readily visible and ventilated. The sections can be quickly and inexpensively manufactured and assembled and the sections, except for the mesh portion, may be stamped from a single blank.

Although the invention has been described with respect to use in a preexisting drawer, and of a size to fit the same, obviously drawer 10 could be sold separately along with the sections 17.

Thus, as seen in FIG. 10, a portable easily assembled knockdown box 100 may be provided comprised of a pair of generally rectangular spaced end walls 101, 102, each wall 101 and 102 having a cut-out midsection 103. A plurality, such as four, of rails 104 through 107 interconnect end walls 101 and 102 at the top and bottom thereof. These rails may be rectangular in cross-section and secured to end walls 101, 102 in any suitable manner, such as by one or more screws 108 screwed through each end wall into the mating rail. Of course, any suitable arrangement may be used to secure rails 104 to 107 to end walls 101, 102. For example, as seen in FIG. 11, each rail, such as rail 109, may terminate in a split arrow end 110 receivable in a rectangular slot 111 in end wall 112. Of course, rail 109 and end 110 are preferably made of a single piece of resilient material with the spacing between points 113, 114 of end 110 being slightly greater than the overall length of slot 111 so that the end 110 can be squeezed together, inserted in slot 111, then spread back apart retaining the end wall 112 in the space 115 between shoulders 116 and 117.

Thus, box 100 can be quickly and easily assembled and disassembled. The organizers 17 as heretofore discussed are suspended on upper rails 104, 105 as discussed heretofore with respect to sides 11, 12 of drawer 10 (rail 109 being otherwise identical to rails 104, 105). The box 100 may stand alone or be part of an overall system, such as a rack system in a closet or the like.

Further, a box or drawer is not necessary to utilize organizers 17. For example, as seen in FIG. 12, a plurality, such as four, spaced vertical uprights 118–121 may be mounted in a closet 122 having horizontal brackets 123, 124 vertically adjustably mounted thereon in any manner known in the art, such as hooks 125 on brackets 123, 124 disposed in slots 126 in uprights 118–121. Organizers 117 are mounted on the top of brackets 123, 124 (the spacing therebetween being preselected) as heretofore discussed. Of course, a plurality of brackets 123, 124 may be mounted on uprights 118–121 to provide more than one level of organizers. Also, a box or drawer similar to box 100 and drawer 10 may be mounted in closet 122 in any suitable manner receiving organizers 17 therein.

Although a mesh-like material 24, 27 has been disclosed for organizers 17, clear plastic may be used, if desired. Also, rails 104–107 of FIG. 10 (and the modified rail 109) may be made of telescoping sections to vary the spacing between end walls 101, 102. This is shown in FIG. 13 wherein rail 127, otherwise identical to rail 109, is comprised of telescoping sections 128, 129, with spaced holes 130 in section 128 and a single hole receiving a screw 131 therein in section 129 so that the sections 128, 129 can be adjustably locked together.

Figure 14:
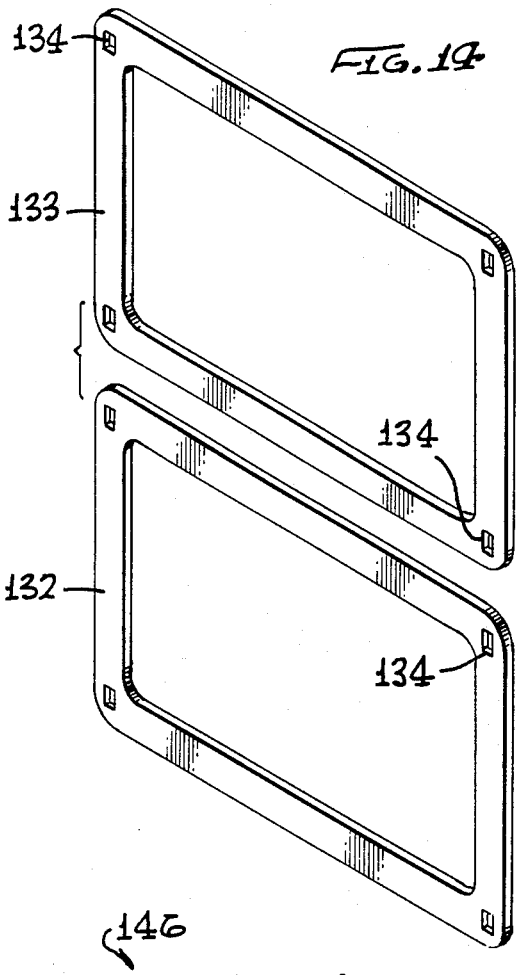
FIG. 14 is an exploded view of another box arrangement in accordance with the invention.
Figure 15:
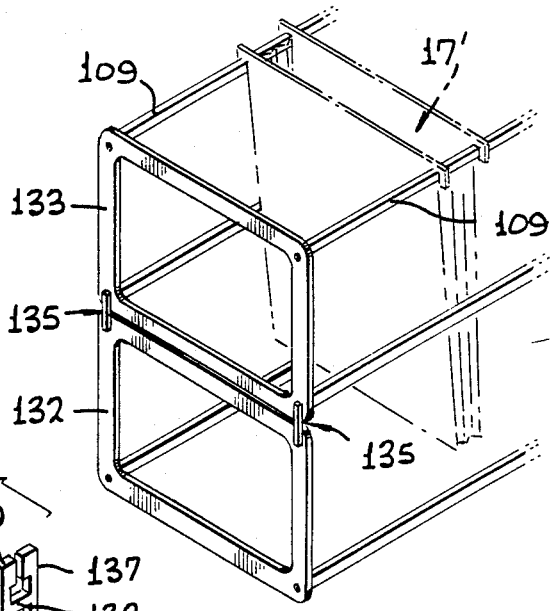
FIG. 15 is an assembled view of the box of FIG. 14.

Although organizers 17 may be of a predetermined height so as to fit into drawer 10 or box 100, these organizers 17 may be of one size and larger (greater in height) organizers may be provided, if desired. For example, as seen in FIG. 14, end walls 132, 133 are shown identical to aforementioned end wall 112 with slots 134 identical to slots 111 at each corner thereof. A connector 135, which may be of a single piece of resilient material, such as plastic, is provided, having a pair of vertical spaced elongated sides 136, 137 interconnected by midsection 138 at generally the middle thereof. Each side 136, 137 terminates at each upper and lower end in an inwardly extending block portion 139 spaced from an adjacent block portion 139. These portions 139 are generally configured similarly to slots 134 and, when one end wall is stacked above the other, as end walls 132 and 133 in FIG. 15, the connectors 135 snap fit into adjacent slots 134 and hold the end walls 132, 133 together. This forms a box (when rails 109 are interconnected thereto) twice as high as box 100. Organizers 17' can be mounted on the upper rails 109 as heretofore discussed and are identical to organizers 17 but twice as long.

Figure 16:
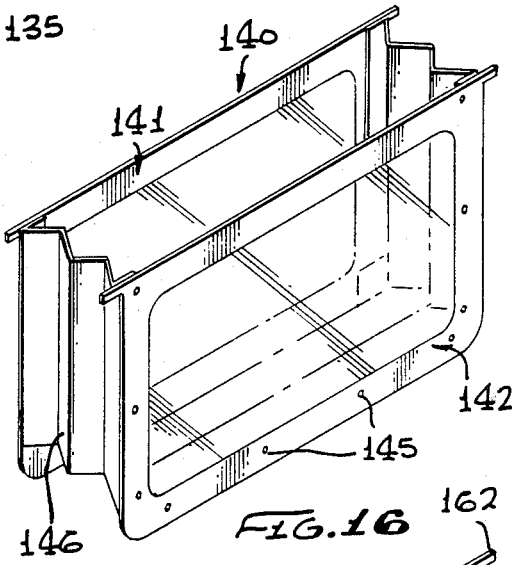
FIG. 16 is a perspective view of another organizer in accordance the invention.
Figure 17:
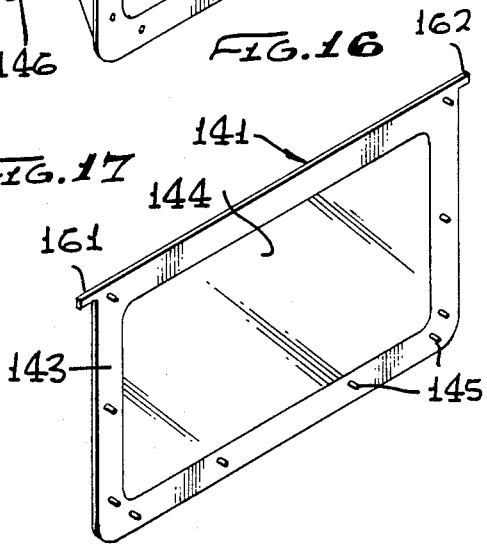
FIG. 17 is a perspective view of a component of the organizer of FIG. 16.

Another embodiment of organizer 17 is shown in FIG. 16. Organizer 140 has a pair of spaced end walls 141, 142, one of the walls being shown in FIG. 17. Thus, wall 141 (wall 142 being identical) may be stamped out of a single piece of transparent plastic material. This piece may be painted or otherwise marked around the inner portion thereof to form a frame 143. That is, frame 143 surrounds an inner generally rectangular area 144 which is transparent or translucent thereby forming a window. A plurality of nubs 145 may be molded or otherwise be provided along the sides and bottom of frame 143. These nubs 145 snap fit into like configured apertures of a section forming the sides and bottom of organizer 140 as will now be discussed.

Figure 18:
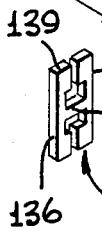
FIG. 18 is a plan view of a component of the organizer of FIG. 16 prior to assembly thereof.
Figure 18:
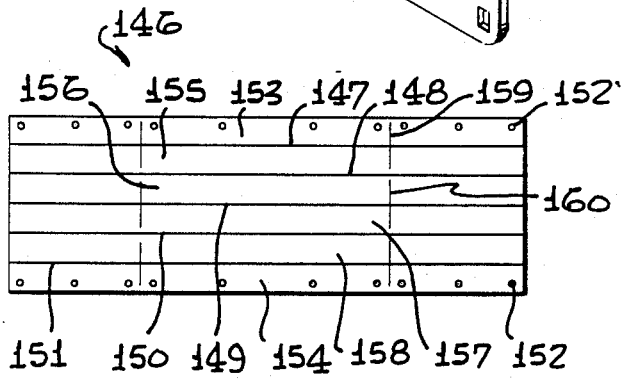

Thus, as seen in FIG. 18, a single rectangular piece 146 of plastic material may be provided folded along longitudinally extending fold lines, such as lines 147–151. A plurality of spaced holes 152 are provided along the outer sections 153, 154 (on the outside of fold lines 147 and 151). The sections are cut, as by cut line 159 through section 153 and section 155, cut line 160 through section 156 and 157, and through sections 158 and 154 at each end thereof. It is to be understood that each cut line terminates at a point just before the fold line and/or the outer edge of the other strips 153, 154 leaving material there and forming a hinge area as will be discussed.

Figure 19:
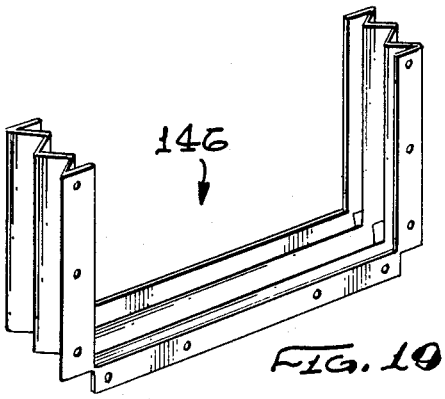
FIG. 19 is an assembled view of the component of FIG. 18.

Thus, piece 146 is folded along the cut lines, as seen in FIG. 19, forming sides and a bottom for the organizer 140 of FIG. 16. The nubs 145 snap fit into aligned holes 152 in piece 146 (FIG. 16). The cut lines form hinges at the two bottom locations, the fold lines giving an accordion effect to the organizer 140. The outwardly extending extension portions 161, 162 (FIG. 17) along the top of each end wall 141, 142 form hooks or support members to support the organizer 140 in a drawer or box or on rails as heretofore discussed with respect to organizers 17 and 17'.

Referring now to FIGS. 20 and 21, another embodiment of an organizer is shown. As seen in FIG. 20, an assembled organizer 200 is shown. Organizer 200 is shown in flat plan view, prior to assembly, in FIG. 21. It is to be understood that organizer 200 may be flat and planar with the fold lines, to be discussed, pre-formed in the organizer, thus forming peaks and valleys when withdrawn from the mold or the like from which the blank of FIG. 21 was made. Thus, organizer 200 has an accordioned base portion 201 formed by spaced fold lines 202 to 210 forming peaks at fold lines 203, 205, 207 and 209 and valleys at fold lines 202, 204, 206, 208 and 210. Front and rear walls 211, 212, respectively, are coupled to base portion 201 at fold lines 202 and 210, respectively. A fold line 213 is provided adjacent fold line 202 on front wall 211 spaced therefrom to provide a slight taper to the bottom of wall 211 when assembled as seen in FIG. 1. A like fold line 214 is provided adjacent fold line 210 on rear wall 212 spaced therefrom to provide a slight taper to the bottom of rear wall 212 when assembled.

A pair of outwardly extending tabs 215, 216 are provided at each end of the upper surface of front wall 211 and a like pair of outwardly extending tabs 217, 218 are provided at each end of the upper surface of rear wall 212. These tabs 215–218 are comparable in function to tabs 161, 162 of the embodiment of FIG. 17 and the tabs 18–21 of the embodiment of FIG. 2 (and, thus, may be configured as in FIG. 2). A plurality of spaced locking means 219 are provided at spaced locations along each side of front and rear walls 211, 212. As seen in FIGS. 22, 23, each locking means 219 includes a pair of spaced rectangularly shaped cut-out areas 220, 221 with a pair of barbed projections 222, 223 (FIG. 22) disposed on the wall portion 224 separating cut-out areas 220, 221. As seen in FIG. 22, these barbed projections form a split arrow for insertion into like spaced holes as will be discussed.

A pair of side panels 225, 226 (FIG. 21) are connected on each side of base portion 201. Each side panel is comprised of a plurality of fold lines 227 to 237. Fold lines 227, 229, 231, 233, 235 and 237 form peaks and fold lines 228, 230, 232, 234 and 238 form valleys. Lines 236 are coincident with line 210 of base portion 201 as are lines 234 and 208; 232 and 206; 230 and 204; and 228 and 202. Open cut-out areas are thus formed between panels 225, 226 and base portion 201 which assist in folding and assembling organizer 200.

A pair of elongated side flaps 238, 239 are formed on each side of each panels 225, 226 along fold lines 227, 237, respectively. A plurality of spaced holes 240 are formed at spaced locations along each flap 238, 239. The aforementioned barbed projections 222, 223 are adapted to be received in these holes 240. Thus, the number of holes and spacing therebetween is related to the number and spacing between projections 222, 223 and the diameter of the latter is also related to the diameter of the holes 240. The projections are thus inserted into the holes, the split therebetween assisting in such insertion and the barbed head thereon prevents easy withdrawal.

The entire organizer of FIG. 21 can be made extruded from a single piece of any suitable plastic material. This material may be otherwise opaque except for a central rectangular transparent or translucent area in each front and rear wall, such as areas 241, 242, respectively. These areas 241, 242 are comparable to the areas 24, 27 of the embodiment of FIGS. 1 and area 144 of the embodiment of FIG. 17 for viewing the contents disposed in the interior of the assembled organizer. The front and rear wall may also have an elongated rectangular opaque area, such as areas 243 on front wall 211 and area 244 on rear wall 212 for applying an identifying label thereto.

In assembling the planar blank of FIG. 21, side panels 225, 226 are folded upwardly about their points of connection to base portion 201. Front and rear walls 211, 212 are now folded upwardly about fold lines 202, 210, respectively. Projections 222, 223 are inserted into holes 240. The final assembled organizer is shown in FIG. 20 and can be suspended within box 100 of FIG. 10 on tabs 215–218 in the same manner as organizer 17. As seen in FIG. 24, the open or cut-out areas between side panels 225, 226 and base portion 201 assist in forming mating parts of the panels with the base portion 20 as at area 201, The organizer 200 is thus economical to manufacture and assemble and is comprised of a single part. A plurality of organizers 200 can be mounted in a framework as in FIG. 10 and the entire assembly, organizers 200 and box 100 placed in a drawer, such as drawer 10 of FIG. 1.

Alternatively, as seen in FIG. 25, a knockdown framework 300 may be provided for insertion into a drawer as in FIG. 1. Framework 300 is comprised of a pair of elongated side members 301, 302 (see also FIG. 27) and a pair of front and rear panels 303, 304 (see also FIG. 27). Each side member 301, 302, such as side member 301 in FIG. 27 has a main elongated portion 305 terminating at each end in downwardly extending triangular portions 306, 307 (see also FIG. 25). An interlocking flange 308 is provided at each end and each flange has a pair of spaced rectangular portions 310 (FIG. 28) forming T-shaped portions with their respective flange as seen in FIG. 28.

Each front and rear panel, such as panel 303 (FIG. 27) is rectangularly spaced member with a central open area 312 (see FIGS. 25 and 26). A pair of spaced rectangular shaped openings 313, 314 are provided at the upper end of each panel 303 on each side thereof as seen in FIGS. 26, 27 and 28. Each opening 313, 314 has a pair of L-shaped flanges 315, 316 forming, with flange 311, an opening 317 therebetween as seen in FIG. 28. The spaced T-shaped portions 308, 310 of side members 301, 302 are insertible between each pair of spaced flanges 315, 311 to lock therein and form the assembled framework of FIG. 25. As seen in FIG. 27, an inwardly extending flange 309 on the inner wall 309, of members 303 acts as a stop for the side members 301, 302.

As seen in FIG. 29, a large drawer 318 is shown having a plurality of frameworks 300 disposed therein, each framework 300 having a plurality of organizers 200 mounted thereon.

There is thus disclosed a system to organize the contents of dresser drawers or the like. In the past, when one tried to organize his or her dresser drawers, they no doubt had some success, at least until they had occasion to open those drawers. After opening the drawer, they found that whatever was in the front is now in the middle, and what was in the middle is now in the back, and what was in the back is now under all the stuff that was in the front and the middle. The system herein will organize almost any drawer.

There is thus disclosed a unique, easy-to-clean, durable unit consisting of translucent expandable containers, or pockets, that are supported and surrounded by a sturdy framework. The framework components are snapped together without tools, the assembled frame is placed into a drawer, the pockets or organizers are placed into the framework, and there is now a place to put those things that were always a problem to organize. The different types of pantyhose and socks and stockings in search of mates and lingerie are now under control. Children's clothes and playthings can be organized in like manner. A drawer can be converted into a mini-desk with pockets for pens and pencils, envelopes and letters, bills and receipts. Each pocket has a space for labeling to tell one exactly where to find them.

Although particular embodiments of the invention has been disclosed, other embodiments for carrying out the invention may occur to an artisan and the invention is to be limited only by the scope of the appended claims.

We claim:

1. A blank for forming a selectively expandable and compressible section for suspending on the side walls of a drawer or the like comprising:

a flat planar sheet having a pair of substantially identical rectangular section connected along one side thereof by a fold line to an elongated strip;

cut-out areas generally centrally located in each of said rectangular sections;

trapezoidally-shaped sections extending from opposite sides of said strip, each of said trapezoidally-shaped sections having a top, a base and sides interconnecting the top and base, the base being longer than the top, a fold line connecting the latter to said strip;

each of said rectangular sections having a flap on each side thereof extending in a direction transverse to the longitudinal axis of said strip, all of said flaps having a fold line extending down the middle thereof with a plurality of spaced slots on each side of said fold line, the slots in one row along one side of said fold line being aligned with the slots in the other row along the other side of said fold line;

a plurality of spaced tabs extending along each side of said trapezoidally-shaped sections, the spacing between adjacent ones of said tabs being the same as the spacing between adjacent ones of said slots along one row thereof;

score lines extending from the fold line connecting the top of said trapezoidally-shaped sections along the sides thereof to the sides of said rectangular sections;

a tab on each of said rectangular sections on the side thereof opposite the side connected to said strip, said tab having a fold line along the center thereof extending parallel to the longitudinal axis of said strip; and a T-shaped member extending from each end of said last-mentioned tab, each of said T-shaped members having an elongated portion having a fold line along its central axis coincident with the fold line through said last-mentioned tab, and a cross member portion having its central axis extending transverse to the central axis of said elongated portion connected to said elongated portion at generally its midpoint, said cross member portion having a fold line coincident with the fold line through said extension portion.

2. In the blank of claim 1 including slots in said last-mentioned tab on each side of the fold line therethrough adjacent each of said extension portions.

3. In the blank of claim 2 including a plurality of spaced fold lines extending along each of said trapezoidally-shaped sections from the base to the top thereof.

4. In the blank of claim 3 including a plurality of spaced fold lines extending along said strip.

5. A blank for forming a selectively expandable and compressible section for suspending on the side walls of a drawer, framework or box or the like comprising:

a flat planar sheet having a pair of substantially identical first generally rectangular sections connected along one side thereof by a fold line to an elongated strip;

translucent areas generally centrally located in each of said rectangular sections;

second generally rectangular sections extending from opposite sides of said strip, each of said second rectangular sections having a top, a base and sides interconnecting the top and base, said base being connected to said strip and an apertured flap extending along each side thereof;

each of said rectangular sections having a tab on each side of the upper edge thereof extending outwardly thereof;

each of said second rectangular sections and said strip having a plurality of spaced fold lines forming alternating peaks and valleys, the bases of said second rectangular sections being connected to said strip at a plurality of spaced points coincident with fold lines of said rectangular sections and said strip with open cut-out areas being provided between said second rectangular sections and said strip; and a plurality of projecting means at spaced locations along both sides of said first rectangular sections extending normal to the fold lines of said strip to which each of said first rectangular sections are connected, the spacing between said projecting means being related to the spacing between the openings in said apertured flaps of said second rectangular sections.

* * * * *